US005670930A

United States Patent [19]

Hofsäss, deceased et al.

[11] Patent Number: 5,670,930

[45] Date of Patent: Sep. 23, 1997

[54] TEMPERATURE-DEPENDENT SWITCH

[76] Inventors: Peter Hofsäss, deceased, late of Pforzheim; by Ulrika Hofsäss, legal representative, Strietweg 45, 75181 Pforzheim; by Marcel Peter Hofsäss, legal representative, Strietweg 45, 75181 Pforzheim; by Denise Petra Hofsäss, legal representative, Strietweg 45, 75181 Pforzheim; by Henrik Peter Hofsäss, legal representative, Strietweg 45, 75181 Pforzheim; by Carola Rika Hofsäss, legal representative, Strietweg 45, 75181 Pforzheim; by Benjamin Michael Hofsäss, legal representative, Strietweg 45, 75181 Pforzheim, all of Germany

[21] Appl. No.: 330,932

[22] Filed: Oct. 28, 1994

[30] Foreign Application Priority Data

Oct. 30, 1993 [DE] Germany ..... 43 37 141.8

[51] Int. Cl.[6] ..... H01H 37/04

[52] U.S. Cl. ..... 337/380; 337/342; 337/365

[58] Field of Search ..... 337/36, 298, 333, 337/334, 380, 381, 342, 365

[56] References Cited

U.S. PATENT DOCUMENTS 3,755,770 8/1973 Andersen .
4,306,211 12/1981 Hofsass ..... 337/89
4,849,729 7/1989 Hofsäss ..... 337/102

FOREIGN PATENT DOCUMENTS 21 06 132 2/1971 Germany .
2106132 10/1971 Germany .
2121802 1/1973 Germany .
9214544 2/1993 Germany .

*Primary Examiner*—Leo P. Picard
*Assistant Examiner*—Jayprakash N. Gandhi
*Attorney, Agent, or Firm*—Harness, Dickey & Pierce, P.L.C.

[57] ABSTRACT

A temperature-dependent switch (10) to close or open an electric circuit depending on the temperature of a bimetallic part (26) comprises an electrically conductive housing (12) with an underside (13). An electrically conductive cover (16) is provided to close the housing (12). There is an insulating disk (17) between the housing (12) and the cover (16) which electrically isolates the housing (12) from the cover (16). The housing (12) contains a switching device (15) which makes or breaks an electric contact between the housing (12) and the cover (16) depending on the temperature of the bimetallic part (26), whereby the electric circuit can be connected on the one hand to the cover (16) and on the other to the housing (12). The housing (12) is provided with a collar (35) inset into the underside (13), such that a strand can be connected to the collar (35) without affecting the overall height of the switch (10)

19 Claims, 5 Drawing Sheets

TEMPERATURE-DEPENDENT SWITCH

BACKGROUND OF THE INVENTION

FIELD OF THE INVENTION

The invention relates to a temperature-dependent switch to open and close an electric circuit depending on the temperature of a bimetallic part, with a conductive housing which has a base, an electrically conductive cover for closing the housing, an insulating disk between the housing and the cover which isolates the housing from the cover, and a switching device in the housing which makes or breaks an electric contact between the housing and the cover depending on the temperature of the bimetallic part, whereby the electric circuit can be connected on the one hand to the cover and on the other to the housing.

Such temperature-dependent switches are known per se.

BACKGROUND AND SUMMARY OF THE INVENTION

The known switches are used to monitor the temperature of a device. For example, their bases make contact with the coil of a motor so that the temperature of the coil affects the bimetallic part. If the switching temperature is exceeded the switching device breaks the contact between the cover and the housing, and the electric circuit which passes through these is interrupted. If the temperature drops the electric circuit is reclosed, though this must not necessarily be the case since bistable temperature-dependent switches are also known.

The known switches are usually provided with pigtails which are soldered on to the cover and to one edge of the housing. The floor of the housing cannot be used for a pigtail connection since this would interfere with the temperature junction to the monitored device. Further, switches whose housing base does not make direct contact with a monitored device, neither have a connection on the underside of their housing since this would lead to a larger overall height of the temperature-dependent switch.

The cover is normally pushed into the housing and the protruding edge of the housing flanged in such a way that it clamps the cover tight. The pigtail, which makes the contact with the housing, is then soldered onto the flanged border. The second pigtail is soldered directly onto the cover.

The disadvantage here is that soldering robots have to be used during production and these are expensive and slow.

This type of switch is manufactured in such a way that the switching device is firstly inserted into the housing before the insulating disk is placed on the housing and pushed into this with the aid of the cover. A frequent problem here is that the insulating disk slips so that there is no reliable isolation between the housing and the cover. This manufacturing process can thus lead to rejects.

Some of the processes which have been described up to now are still carried out by hand or semi-automatically so that the production and assembly of the known temperature-dependent switches is wage-intensive and thus cost-intensive.

A similar temperature-dependent switch with a two-part casing is known from DE-A 21 21 802. In this switch the cover and housing are each provided with a terminal lug which is possible here on account of the two-part casing. For this purpose, the upper part of the housing, which overlaps the lower half of the housing has a slot in its peripheral border through which the terminal lug of the lower half of the housing protrudes. This means that both parts of the housing are complicated stampings which are not stable under pressure, partly on account of the slot.

Compared to this, the generic switch has the advantage that the cover is inserted into a housing, thus leading to a higher stability under pressure, though this also has the disadvantage that the pigtails have to be soldered onto the housing.

The insulating disk is applied separately from the upper half of the housing in this type of switch too so that the very lightweight insulating disk can easily slip during manufacture.

The switching device in the known switch has a spring washer into which a contact part is placed and this makes contact with the upper part of the housing. A bimetallic snap washer is placed over the spring washer which is accommodated without force in the housing in case the temperature is below the switching temperature. The current conduction takes place via the conductive upper half of the housing, the contact part, the spring washer and the lower half of the housing on which the spring washer rests. If the switching temperature is exceeded the bimetallic snap washer snaps and pushes the spring washer with its contact away from the upper half of the housing.

The contact part has a ring with which it is clamped between the spring washer and the bimetallic snap washer. The contact part must be inserted "loosely", as it were so that no mechanical stresses or forces are exerted on the spring washer which could otherwise influence its movements.

Since the contact part is fitted separately this type of switch repeatedly suffers from problems with jammed contact parts, which also leads to rejects during production.

On the basis of this state of the art the object of the present invention is to improve the switch mentioned at the outset in such a way that its manufacture and possible assembly with terminal lugs is faster, less costly and more reliable than with the current state of the art whereby the smallest possible overall height should be achieved.

In accordance with the invention this object is achieved with the above-mentioned temperature-dependent switch in that the housing part is provided with an external collar inset from the underside.

The problem upon which the invention is based is completely solved in this manner. A strand can be connected to this collar, inset from the base, without this affecting the overall height or the temperature contact which may be made via the base of the housing. The strand can now be welded not only onto the cover but also onto the collar, e.g. through electric spot welding, a process which is considerably faster than state-of-the-art soldering. This collar already represents a great improvement in the production and assembly of the new temperature-dependent switch.

It is preferred that the switching device comprises an electrically conductive spring washer which acts against the bimetallic part depending on the temperature of this bimetallic part and which rests on the housing and bears a contact part which makes contact with the cover depending on the temperature of the bimetallic part, thus making electrical contact between the housing and the cover, whereby the bimetallic part is preferably a bimetallic snap washer.

One advantage here is that the switching device known from DE-A 21 21 802 is used, this having a low overall height. For further details of this switching device, reference is made to the disclosure of that document the contents of which thus become the subject matter of the present application.

The contact part should hereby preferably be fixed to the spring washer by means of welding.

An advantage of this measure compared to the generic switch—in other words without collar—is that the production of the new switch is simplified since the contact part can now be fastened to the spring washer before installation so that it cannot slip during assembly. This increases not only the assembly speed, it also significantly reduces the number of rejects.

Surprisingly, welding is possible without affecting the movements of the spring washer.

It is furthermore preferred if a terminal lug is provided, the first end of which is preferably connected to the collar by welding, and whose second end, distant from the first, is used as a connection.

A further advantage here is that the collar only has to be inset slightly from the underside on account of the thinness of the terminal lug, which further reduces the overall height. The strand can then be welded to the second end of this terminal lug. Although two welding jobs have to be performed here to make the connection between the strand and the housing, this on the whole takes much less time than a state-of-the-art soldering of the strand to the flanged border of the housing.

Another advantage is that the mechanical tensile strength of the new connection, made via the terminal lug, is much better than with a soldered connection on the flanged border.

It is preferential if the collar is a continuous ring collar and the first end of the terminal lug is ring-shaped.

This once again facilitates production since no positioning work for the terminal lug and housing is necessary, rather the housing with its underside is pressed into the ring-shaped end so that this rests on the collar, and is thus automatically centred.

It is then preferential if the terminal lug is bent in such a way that its second end is inset from the collar.

This means that the assembled switch has a very low overall height since the terminal lug and strand protrude neither above nor below the switch.

It is also preferential if a second terminal lug is provided whose first end is preferentially welded to the cover and whose second end, opposite to the first, serves as a connection.

This then has the same advantages as the first terminal lug, the overall height of the switch is once again reduced. The very thin terminal lug now only has to be welded to the cover whereas the strand for connection to the electrical circuit can be welded outside of the switch's contour.

It is hereby preferential if the second terminal lug is bent in such a way that its second end is inset from its first.

This in turn has the same advantages as for the first terminal lug, the overall height is namely further reduced since the terminal lugs and the strands welded to these do not protrude beyond the height of the switch. This also facilitates assembly since the two radially offset ends of the two terminal lugs are on the same level and adjacent to one another so that the strands can be laid parallel and welded. This leads to a considerable time advantage especially since welding robots are used which are not only more economical than the state-of-the-art soldering robots but are also much faster, in other words have a higher operational capacity.

It is moreover preferential if the two terminal lugs are stampings, preferably of sheet steel.

The advantage here is that the terminal lugs themselves can be manufactured quickly and economically so that the overall costs for the manufacture and assembly of the new switch are greatly reduced compared to the state-of-the-art.

On the whole it is preferential if the housing is a deep-drawn housing part.

Such a deep-drawn housing part is very economical in its manufacture so that the overall costs of the production of the new switch can be reduced.

It is furthermore preferred if there is a countercontact to the contact part in the cover.

The advantage of this is that it is an economical and simple way to enable a lower contact resistance between the spring washer and the cover.

It is furthermore preferential if the second terminal lug and the countercontact are welded on in one process.

A further advantage here is that two fastenings are affixed in one single step, thus reducing the necessary production time.

On the whole it is also preferential if the insulating disk is fixed to the cover before assembly of the switch.

This already has the great advantage in a generic switch, in other words without the new collar, that no positioning is necessary between the insulating disk and cover during production of the switch. Since the insulating disk can no longer slip not only is the reject rate reduced, human assistants can also be dispensed of to a large extent during manufacture, making production significantly faster and more economical. Thus, a generic switch is already faster and easier to manufacture even without the new collar so that the problem mentioned at the beginning is solved separately.

It is then preferential if the insulating disk is stuck to the cover, or at least sections thereof.

This bonding can be carried out in a number of ways, for example the cover and insulating disk can be manufactured separately and then stuck together. Alternatively, it is also possible to first manufacture the covers and then stick these in rows and columns onto insulating paper and to then punch these out, whereby during punching it is ensured that the insulating disks have a larger diameter than the covers. Moreover, the necessary central hole in the insulating disk through which the contact part of the spring washer can make contact with the cover or the countercontact fastened to this can be made either before or during this punching process.

And finally it is also possible to first stick a steel sheet and sheet of insulating paper together and then punch out or shape the contours of the insulating disk and cover in one or two punching and pressing stages.

This last-mentioned possibility, namely sticking a steel sheet and the insulating paper together first, has a surprising advantage during manufacture since this does away with not only the positioning between the insulating disk and cover during assembly, but also the alignment during the previous fixation of the insulating disk to the cover in accordance with the invention.

Further features and advantages can be taken from the detailed description and enclosed drawing.

It goes without saying that the features named above and explained in the following can be used not only in the specified combinations but also in other combinations or alone without going beyond the scope of the present invention.

BRIEF DESCRIPTION OF THE DRAWINGS

An embodiment of the invention is shown in the drawing and will be explained in more detail in the following detailed description. The drawings show.

DETAILED DESCRIPTION OF THE PREFERRED EMBODIMENTS

Figure 1:
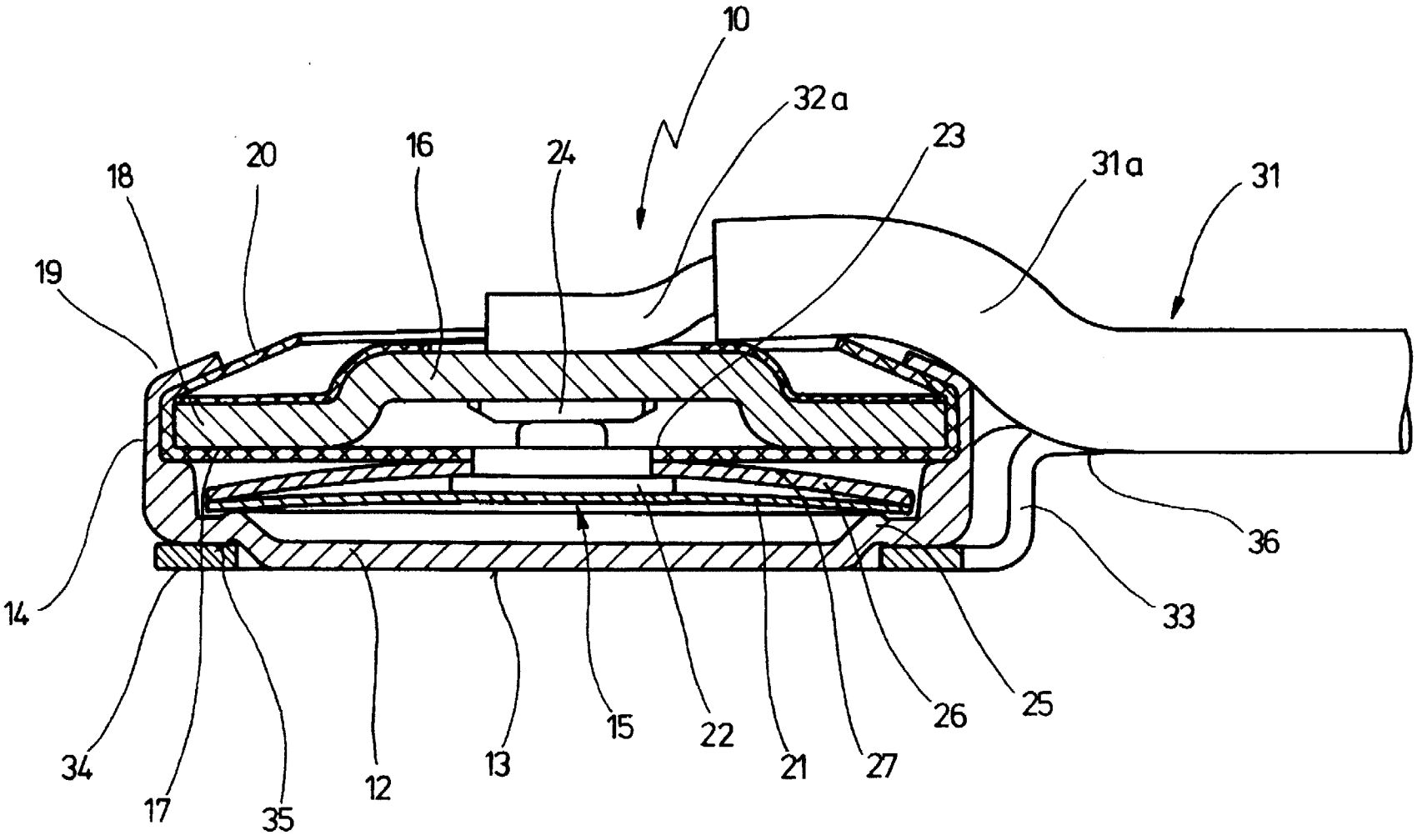
FIG. 1 a schematic sectional side view of the new switch in which a terminal lug is welded onto the cover.

In FIG. 1, 10 is a temperature-dependent switch for a temperature-dependent closing and opening of an electric circuit. The switch 10 comprises a housing 12 whose underside 13 can be applied to a device, or for example the field coil of a motor not shown in FIG. 1, so that the temperature of the device or the motor affects the switching behaviour of the switch in a manner which will be described below in more detail.

The housing 12 has a homogeneous edge 14 and has an essentially circular layout. Inside the housing 12 there is a switching device 15 which makes or breaks an electrical contact between the housing 12 and a cover 16 depending on the temperature of the monitored device. There is an insulating disk 17 between the cover 16 and the housing 12 which electrically isolates the housing 12 from the cover 16.

It can be seen that the insulating disk 17 is folded up around the cover 16 in FIG. 1 so that this isolates the cover 16 around its complete circumference 18 from the edge 14. The cover 16 which is inserted into the raised edge 14, and the insulating disk 17 are held in the housing 12 by flanging the upper end 19 of the edge 14. The switching device 15 is thus firmly fixed in the switch 10, whereby a border 20 of the insulating disk 17 protrudes upwards.

The switching device 15 comprises a spring washer 21 onto which a contact part 22 is welded. This contact part 22 protrudes through a central hole 23 in the insulating disk 17 to a countercontact 24 which is welded onto the inside of the cover 16 in the switching condition shown in FIG. 1. The spring washer 21 presses the contact part 22 against the countercontact 24 and thus ensures a low transition resistance between these two contacts. The spring washer 21 rests on a circumferential collar 25 inside the housing 12. Since both the housing 12 and the cover 16 and spring washer 21 are manufactured of electrically conductive materials the switching device thus represents an electrical contact between the housing 12 and the cover 16.

There is a bimetallic part 26, in this case a bimetallic snap washer 27, between the spring washer 21 and the insulating disk 17 which also has a central hole through which the contact part 22 protrudes.

In the position shown in FIG. 1 the bimetallic snap washer 27 is unstressed, the switching temperature has not yet been reached. If the temperature of the monitored device rises this is transmitted, for example, via the underside 13 or also via the connections. The temperature of the bimetallic snap washer 27 also rises so that this snaps and pushes the spring washer 21 in FIG. 1 downwards so that the contact part 22 comes away from the countercontact 24 and breaks the electrical contact between the housing 12 and the cover 16.

The switch 10 described insofar is provided with pigtails 31, of which only the pigtail 31*a* is shown in FIG. 1, whose bared end is welded onto the cover 16. The contact to the housing 12 is made via a terminal lug 33, one of whose ends is circular-shaped at 34. This circular end 34 of the terminal lug 33 rests on an external, circumferential collar 35 of the housing 12 which is inset into the underside 13. The size of this inset for the collar 35 and the thickness of the terminal lug 33 have been chosen so that the terminal lug 33 does not protrude from the bottom of the underside of the housing 12 in the area of its circular end 34. This enables a low overall height and also means that if desired the underside 13 can rest directly on the device to be monitored, thus ensuring a good heat transfer.

Moreover, in FIG. 1 it can also be seen that the first terminal lug 33 is bent in such a way that its second end 36, distant from the first end 34, is inset from the collar 35. A further pigtail is fastened to this second end 36, though this is not shown in FIG. 1.

Figure 2:
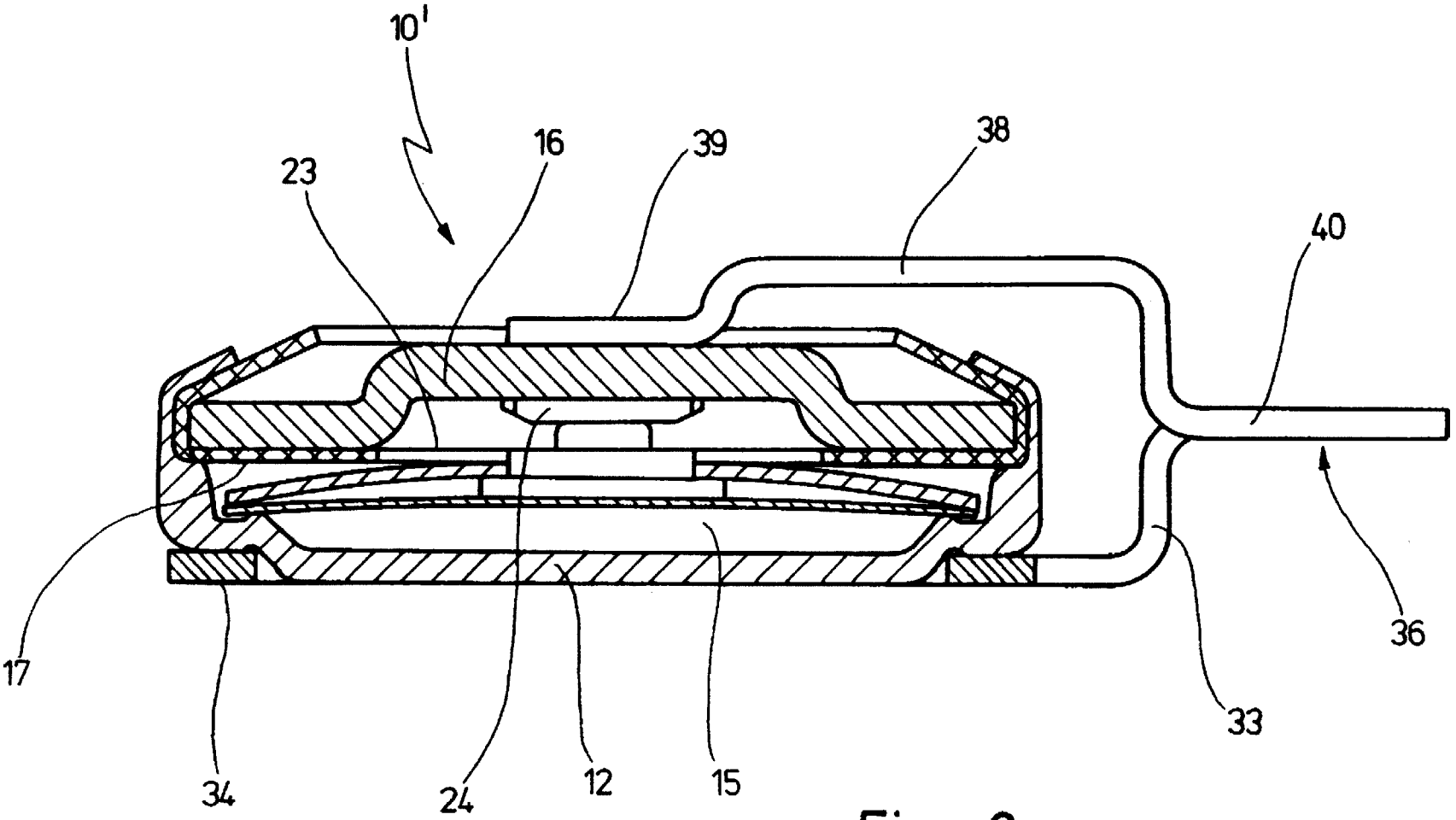
FIG. 2 in a view as in FIG. 1 a further embodiment of the new switch in which a further terminal lug is provided for the connection to the cover.

FIG. 2 shows a further embodiment of a temperature-dependent switch 10' in which the connection to the cover 12 is made by a further terminal lug 38. The first end 39 of the second terminal lug 38 is welded from above onto the outside of the cover 16 and is bent in such a way that the second end 40, distant from the first end 39, is recessed or inset from the first end 39 in FIG. 2. The arrangement is such that the second end 40 of the second terminal lug 38 is radially offset but roughly on the same level as the second end 36 of the first terminal lug 33.

As for the rest the switch 10' corresponds to the switch 10 in FIG. 1. Only the central hole 23 in the insulating disk 17 is larger in switch 10' than in switch 10.

The switch 10, 10' is preferably manufactured in a manner whereby firstly the housing 12 is made by deep drawing, a very economical method. The contact part 22 is welded onto the spring washer 21. The first terminal lug 33 is also welded onto the housing 12. The spring washer 21 and bimetallic snap washer 27 are then inserted into the housing 12.

The cover 12, to which the insulating disk 17 has been stuck in a manner which will be described in more detail in the following, is firstly provided with the countercontact 24 and the second terminal lug 38 before being pressed into the housing 12. The upper end 19 of the upright edge 14 is then flanged, thus completing assembly of the switch 10, 10'.

Naturally, it is possible to weld the terminal lugs 33, and 38 on later. In the case of switch 10 the pigtail 31*a* is welded on in place of the second terminal lug 38.

Following assembly of the switch 10' as described above the pigtails 31 are welded onto the second ends 36 and 40 of the terminal lugs 33 and 38. This welding takes place outside the layout contour of the switch 10' and can be carried out easily, quickly and economically preferably by electric spot welding.

The assembly of the switch 10, 10' is very easy and no complicated positioning is necessary on account of the fixation of the insulating disk 17 to the cover 16 and the contact part 22 to the spring washer 21 before manufacture. Since all connections can be made by welding not only the manufacture but also the assembly with pigtails 31 is simple, fast and economical.

Figure 3:
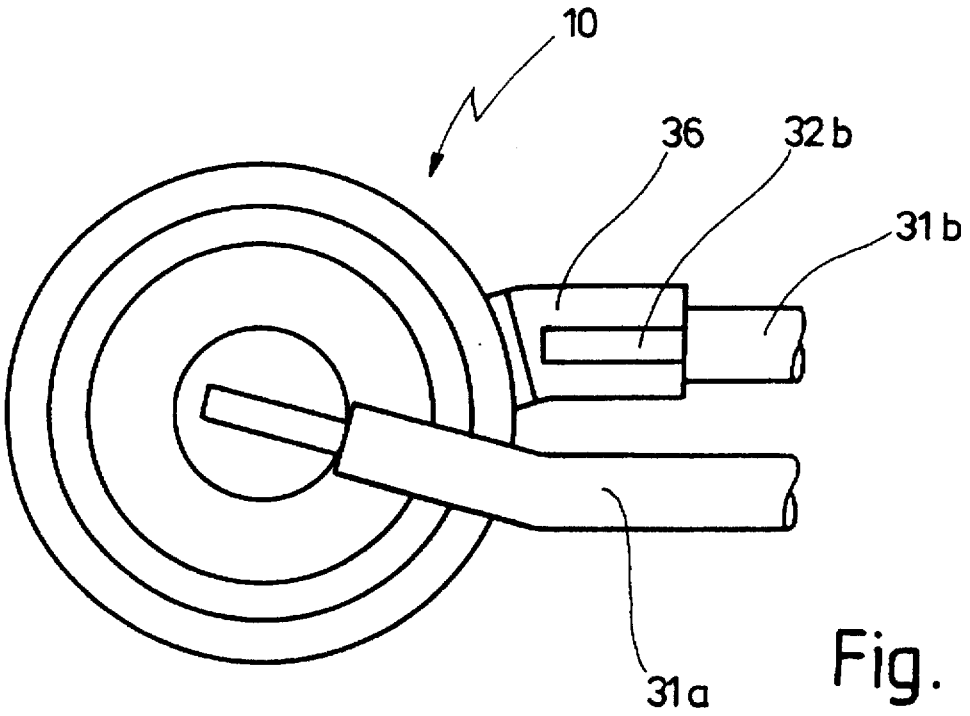
FIG. 3 a top view of the switch in FIG. 1.

FIG. 3 shows a top view of the switch 10 in FIG. 1 so that the pigtail 31*b* can be seen together with the pigtail 31*a*. The bare end 32*b* of this pigtail 31*b* is welded onto the second end 36 of the first terminal lug 33.

Figure 4:
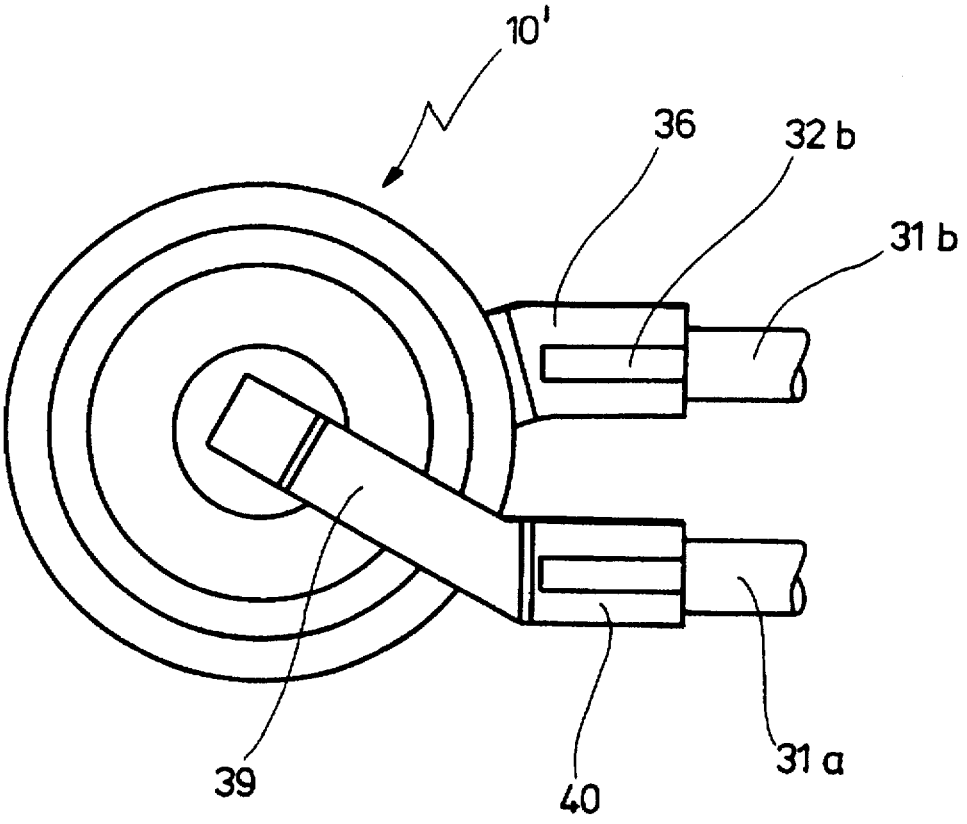
FIG. 4 a top view of the switch in FIG. 2.

FIG. 4 shows a top view of the switch 10' in FIG. 2 whereby the pigtails 31*a* and 31*b* which have been welded onto the switch are also shown.

Figure 5:
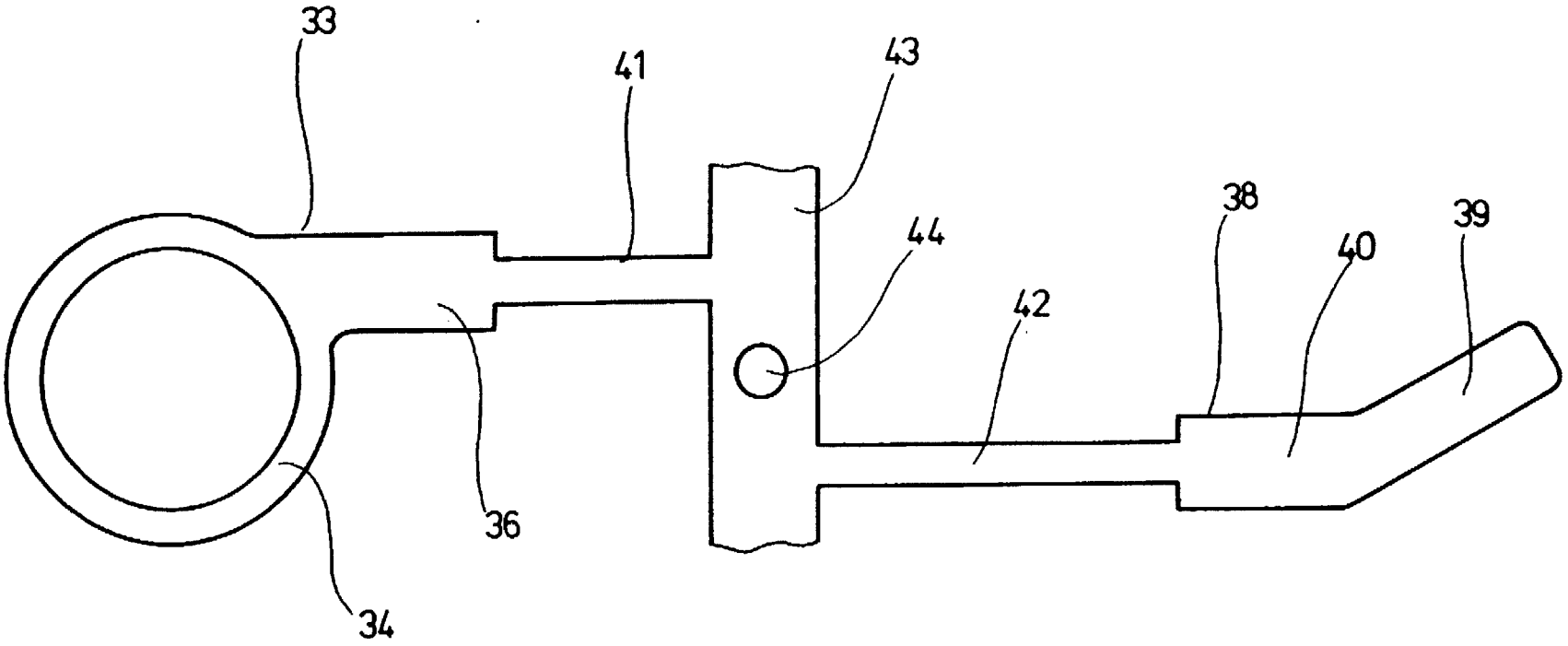
FIG. 5 in a section a sheet steel stamping for both the first and second terminal lug according to FIG. 2.

FIG. 5 shows the first terminal lug 33 and the second terminal lug 38 which are manufactured as low-price stampings, preferably of sheet steel. The terminal lugs 33 and 38 are connected via connecting fins 41 and 42 to a transport fin 43 containing transport holes 44. FIG. 5 is only a sectional representation, the transport fin 43 in FIG. 5 extends upwards and downwards and has additional terminal lugs 33 and 39.

Figure 6:
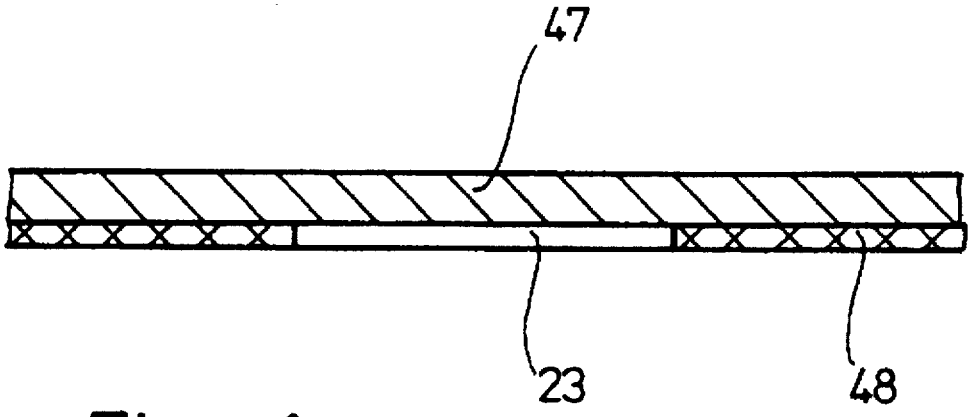
FIG. 6 a layer of insulating paper stuck to a steel sheet as a blank for the manufacture of the cover in FIG. 2.
Figure 7:
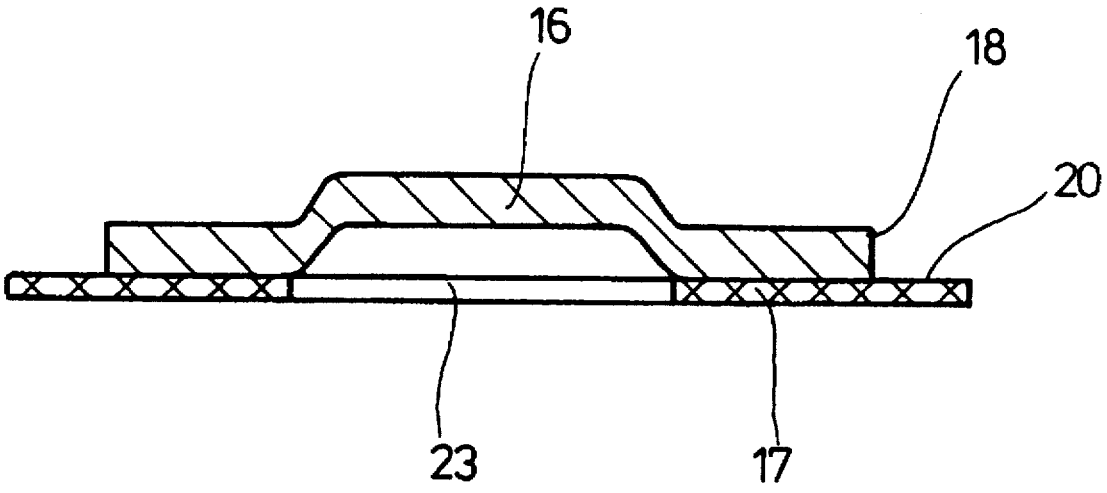
FIG. 7 the cover with affixed insulating disk following punching and pressing of the blank from FIG. 6.

Finally, FIGS. 6 and 7 explain how the cover 16 and insulating disk 17 are fixed. A sheet 48 of insulating material is stuck to a steel sheet 47, as shown in FIG. 6. The sheet 48 already has the central holes 23. These central holes 23 are arranged in rows and columns.

The sheet steel 47 with stuck-on sheet 48 is then processed in a pressing and stamping stage with controlled cutting depth so that the cover 16 with affixed insulating disk 17 as shown in FIG. 7 is produced. In FIG. 7 it can be seen that the edge 20 of the insulating disk 17 protrudes over the circumference 18 of the cover 16. This border 20 folds up when the cover 16 is inserted into the housing 12 and ensures a lateral insulation between the cover 16 and housing 12.

In this simple manner a cover 16 with affixed insulating disk 17 is produced which is a great advantage when assembling a switch 10, 10' since the insulating disk 17 cannot slip in the cover 16.

What is claimed is:

1. Temperature-dependent switch for opening and closing an electric circuit, comprising:

an electrically conductive housing member having an underside and being provided with an external collar means inset from said underside;

an electrically conductive cover member for closing said housing member;

an insulating disk means between said housing member and said cover member for electrically isolating the housing member from the cover member;

a switching device comprising a bimetallic part and being provided in the housing member, which switching device makes or breaks an electrical contact between said housing member and said cover member in dependence of the temperature of said bimetallic part, whereby said electric circuit is to be connected on the one hand to the cover member and on the other hand to the collar means.

2. Switch according to claim 1, whereby said switching device comprises an electrically conductive spring washer means which acts against the bimetallic part depending on the temperature of this part, whereby this spring washer means rests on the housing member and bears a contact part which makes contact with the cover member depending on the temperature of the bimetallic part, thus creating an electrical contact between the housing member and cover member, whereby the bimetallic part is preferably a bimetallic snap washer.

3. Switch according to claim 2, whereby the contact part is preferably permanently fixed to the spring washer means by welding.

4. Switch according to claim 1, whereby a terminal lug is provided whose first end is preferably welded to the collar means and whose second end opposite the first end serves as a connection.

5. Switch according to claim 4, whereby the collar means is a circumferential ring collar and the first end of the terminal lug is of a ring-shaped design.

6. Switch according to claim 4, whereby the terminal lug is bent in such a way that its second end is inset from the collar means.

7. Switch according to claim 1, whereby a further terminal lug is provided whose first end is preferably welded to the cover means and whose second end opposite the first end serves as a connection.

8. Switch according to claim 7, whereby the second terminal lug is bent in such a way that its second end is inset from the first end.

9. Switch according to claim 4, whereby the terminal lugs are stampings, preferably of sheet steel.

10. Switch according to claim 1, whereby the housing member is a deep-drawn housing part.

11. Switch according to claim 7, whereby the cover member is provided with a countercontact for the contact part.

12. Switch according to claim 11, whereby the second terminal lug and the countercontact are welded on in one operating cycle.

13. Switch according to claim 1, whereby the insulating disk means is already fixed to the cover member before assembly.

14. Switch according to claim 13, whereby the insulating disk member is stuck to the cover member, at least in sections.

15. Temperature-dependent switch for opening and closing an electric circuit, comprising;

an electrically conductive housing member having an underside;

an electrically conductive cover member for closing said housing member;

an insulating disk disposed between said housing member and said cover member for electrically isolating the housing member from the cover member;

a switching device comprising an electrically conductive spring washer and a bimetallic part disposed in the housing member, the electrically conductive spring washer acting against the bimetallic part depending on the temperature of the bimetallic part, whereby the spring washer rests on the housing member and has a contact part welded to the spring washer for making contact with the cover member depending on the temperature of the bimetallic part, thus creating an electrical contact between the housing member and cover member, whereby said electric circuit is to be connected on the one hand to the cover member and on the other hand to the housing member.

16. Switch according to claim 15, whereby the bimetallic part is a bimetallic snap washer.

17. Temperature-dependent switch for opening and closing an electric circuit, comprising:

an electrically conductive housing member having an underside and being provided with an external collar means inset from said underside;

a terminal lug welded with its first end to the collar means;

an electrically conductive cover member for closing said housing member;

an insulating disk disposed between said housing member and said cover member for electrically isolating the housing member from the cover member;

a switching device comprising a bimetallic part and being provided in the housing member, which switching device makes or breaks an electrical contact between said housing member and said cover member in dependence of the temperature of said bimetallic part, whereby said electric circuit is to be connected on the one hand to the cover member and on the other hand to a second end of said terminal lug.

18. Switch according to claim 17, whereby the collar means is a circumferential ring collar and the first end of the terminal lug is of a ring-shaped design.

19. Switch according to claim 17, whereby the terminal lug is bent in such a way that its second end is inset from the collar means.

* * * * *